US005634860A

United States Patent [19]

McIntosh et al.

[11] Patent Number: 5,634,860

[45] Date of Patent: Jun. 3, 1997

[54] GOLF CLUB AND SHAFT THEREFOR

[75] Inventors: William R. McIntosh, Bartlett; Jeffrey E. Kitchens, Cordova, both of Tenn.

[73] Assignee: Emhart Inc., Newark, Del.

[21] Appl. No.: 614,589

[22] Filed: Mar. 13, 1996

[51] Int. Cl.[6] ..... A63B 53/12

[52] U.S. Cl. ..... 473/318; 473/323; 473/320

[58] Field of Search ..... 473/316, 317, 473/318, 319, 320, 321, 322, 256, 226, 323; 273/DIG. 7, DIG. 23

[56] References Cited

U.S. PATENT DOCUMENTS

| | | |
|---|---|---|
| 1,418,039 | 5/1922 | Tousey . |
| 1,486,572 | 3/1924 | Forsyth . |
| 1,688,473 | 10/1928 | Sippel . |
| 1,781,116 | 11/1930 | Link et al. . |
| 1,796,274 | 3/1931 | Bryant . |
| 1,980,031 | 11/1934 | Brading . |
| 1,997,853 | 4/1935 | Buhrke . |
| 2,124,534 | 7/1938 | Barnhart . |
| 2,153,550 | 4/1939 | Cowdery . |
| 3,764,137 | 10/1973 | Petro . |
| 4,097,626 | 6/1978 | Tennant . |
| 4,131,701 | 12/1978 | Van Auken . |
| 4,330,126 | 5/1982 | Rumble . |
| 4,415,156 | 11/1983 | Jorgensen . |
| 5,251,896 | 10/1993 | Gerlach . |
| 5,277,423 | 1/1994 | Artus . |
| 5,294,119 | 3/1994 | Vincent . |
| 5,297,791 | 3/1994 | Negishi . |
| 5,316,299 | 5/1994 | Feche . |
| 5,467,984 | 11/1995 | Veux . |
| 5,496,028 | 3/1996 | Chien . |
| 5,551,691 | 9/1996 | Harada ..... 473/318 |

FOREIGN PATENT DOCUMENTS

| | | |
|---|---|---|
| 1259879 | 10/1989 | Japan . |
| 254121 | 11/1995 | Taiwan . |
| 2146906 | 5/1983 | United Kingdom . |
| 2250443 | 6/1992 | United Kingdom . |

*Primary Examiner*—Sebastiano Passaniti
*Attorney, Agent, or Firm*—E. D. Murphy

[57] ABSTRACT

A golf club 10 includes a shaft 12 with a grip 14 assembled on a butt end 16 of the shaft. A club head 18 is mounted on a tip end 20 of the shaft 12. The shaft 12 is composed of steel and is formed with an intermediate section 22 having a plurality of sections 22a through 22n of decreasing diameter from the butt end 16 toward the tip end 20. A bulge 24 is formed in the shaft 12 near an inboard extremity of the tip end 20. The bulge 24 is formed with a central cylindrical section 26 with three cylindrical step surfaces 30, 32 and 34 at one axial end of the section 26 and three step surfaces 36, 38 and 40 at the opposite axial end of the section 26. The diameter of the central section 26 is greater than the diameter of the immediately adjacent portions of the shaft 12. Also, the diameters of each set of the three step surfaces at each end of the central section 26, that is surfaces 30, 32 and 34 at one end and surfaces 36, 38 and 40 at the other end, are successively greater than the adjacent portion of the shaft, but less than the diameter of the central section 26.

22 Claims, 3 Drawing Sheets

10
11
12
13
14
16
18
20
22
22a
22b
22c
22d
22e
22f
22g
22h
22i
22j
22k
22l
22m
22n
24
26
30
32
34
36
38
40
2
2

11
13
20
22n
24
26
30
32
34
36
38
40

GOLF CLUB AND SHAFT THEREFOR

BACKGROUND OF THE INVENTION

This invention relates to a golf club and a shaft therefor and particularly relates to a golf club and a shaft therefor having structure which increases the opportunity for making clubs of lighter weight with enhanced flexibility and torsional characteristics.

Golfing is a world wide sport with increasing popularity. With the increase in the golfing population, there is a significant increase in the number of players with a discerning demand for golf clubs which will improve and enhance their playing of the game. This demand goes well beyond those who play professionally and those in the upper levels of the amateurs.

Typically, some of the aspects of concern for the discerning golfer are the weight of the club, a balance between the flexibility and the stiffness of the shaft, and the torsional character of the shaft. Golfers usually prefer a light-weight club for obvious reasons. However, the flexibility and torsional requirements vary amongst golfers and relate to the golfer's "feel" of the club when the club is swung and upon impact with the ball.

In an effort to provide golf clubs which generally address the concerns noted above, many designs of shaft configuration and composition have evolved over the years. Some of these designs involve the placement of an enlargement in a selected portion of the shaft to, in effect, divide the shaft into two sections. One example of this premise regarding metal shafts is disclosed in U.S. Pat. No. 2,050,554 which issued on Aug. 11, 1936. An example of such structure in a composite or non-metallic shaft is disclosed in United Kingdom Patent No. GB 2,250,443 which issued on Aug. 24, 1994.

While golf clubs having shafts with a variety of such enlargement designs have been effective, there is a continuing demand and need for further improvement in this aspect of shaft design.

In addition, each club within a set of clubs typically has parameters which are different from the parameters of the other clubs in the set. For example, the club length, club weight, head configuration and other club parameters of each of the clubs of a set is different from the same parameters of the other clubs in the set. This equates to a different Moment-of-Inertia and different torsional requirement for each club with respect to each of the other clubs of the set. Therefore, each time the golfer uses a different club from the set in the normal playing of the game of golf, the golfer experiences different reactions from the swinging of the various clubs of the set which could affect the consistency in the golfer's playing of the game.

In view of this potential inconsistency, there is a need to balance or match the clubs of a set so that torsional stability of each club is normalized with respect to the other clubs of the set and the reaction realized by the golfer is somewhat consistent from club to club of the set.

SUMMARY OF THE INVENTION

It is, therefore, an object of this invention to provide a golf club, and a shaft therefor, with improved characteristics leading to enhanced playing of the game of golf by the users of a club employing such a shaft.

Another object of this invention is to provide a golf club shaft which is sectionalized to enhance performance characteristics of a golf club which employs such a shaft.

Still another object of this invention is to provide a shaft which is adaptable for use with the different clubs of a set to provide general uniformity and matching in the torsional characteristics of the different clubs and thereby enhance a golfers opportunity to play the game of golf within the normal ability of the golfer.

With these and other objects in mind, this invention contemplates a golf club shaft which includes a metallic body extending longitudinally along an axis of the body. The body is formed with a butt end at one end of the body and has an inboard extremity of a prescribed diameter and an outboard extremity. The body is further formed with a tip end at an end of the body axially opposite the butt end and spaced axially therefrom wherein the tip end has an inboard extremity of a diameter less than the prescribed diameter and an outboard extremity. In addition, the body is formed with an intermediate section which extends from the inboard extremity of the butt end toward the tip end. The diameter of an end of the intermediate section which joins the butt end is the same as the prescribed diameter and the diameter of an opposite end of the intermediate section is less than the prescribed diameter. The body is formed with a bulge along the axis thereof. The bulge is formed with radially outward extending, axially spaced, stepped portions which are joined with opposite ends of a central shell-like portion which extends between the stepped portions.

This invention further contemplates a golf club which embodies the shaft contemplated above in combination with a grip assembled on the butt end of the shaft and a club head assembled on the tip end of the shaft.

Other objects, features and advantages of the present invention will become more fully apparent from the following detailed description of the preferred embodiment, the appended claims and the accompanying drawings.

DETAILED DESCRIPTION OF THE INVENTION

Figure 1:
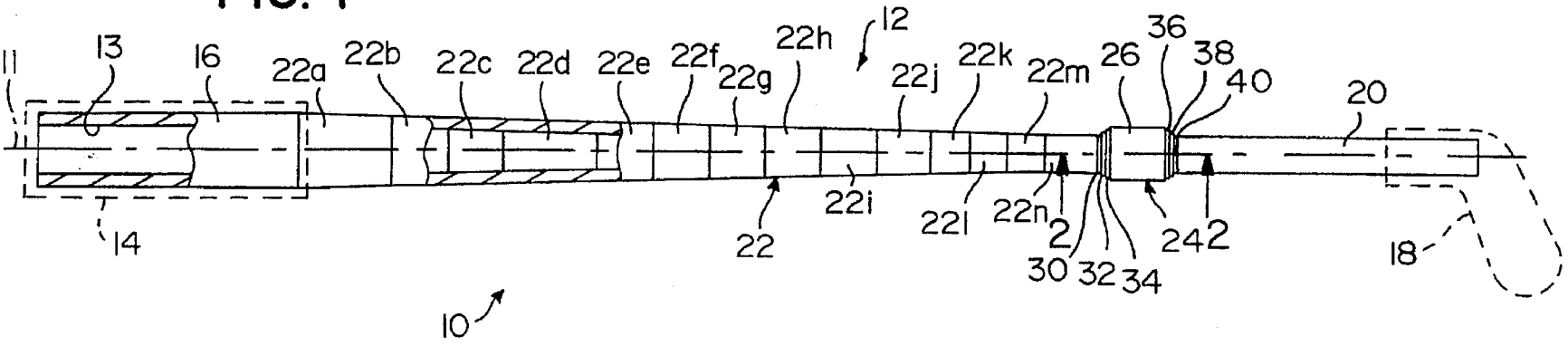
FIG. 1 is a side view with portions broken away showing a golf club including a shaft with a bulge in accordance with certain principles of the invention.

As shown in FIG. 1, a golf club 10 includes a shaft 12 which is formed in a configuration of a hollow body or tube having a longitudinal axis 11 and composed of steel or some other suitable metal such as, for example, titanium. The shaft 12 is formed with an axial opening 13 therethrough. The club 10 further includes a grip 14, shown in phantom, assembled on a cylindrical butt end 16 of the shaft 12 and a club head 18, shown in phantom, mounted on a cylindrical tip end 20 of the shaft. The shaft 12 is also formed with an intermediate section 22 between the butt end 16 and the tip end 20. It is noted that the butt end 16 and the tip end 20 are preferably cylindrical as illustrated, but either or both ends could be tapered without departing from the spirit and scope of the invention.

The intermediate section 22 of the shaft 12 is composed of a plurality of cylindrical sections **22*a* through 22*n* which extend along the axis 11. The sections 22*a* through 22*n* are of decreasing diameters from section 22***a* to section 22*n* and each are formed at a respective length also as indicated in the Parameter Table below. The wall thickness of the shaft 12 increases non-uniformly from about 0.012 inch at the outboard extremity of the butt end 16 to about 0.021 inch at the outboard extremity of the tip end 20. In particular, the wall thickness is about 0.012 inch from the outboard extremity of the butt end 16 generally to section 22*f* and gradually increases to about 0.015 inch between sections 22*f* and 22*i*, to about 0.017 inch between sections 22*i* and 22*n* and to about 0.021 inch at the outboard extremity of the tip end 20.

Figure 3:
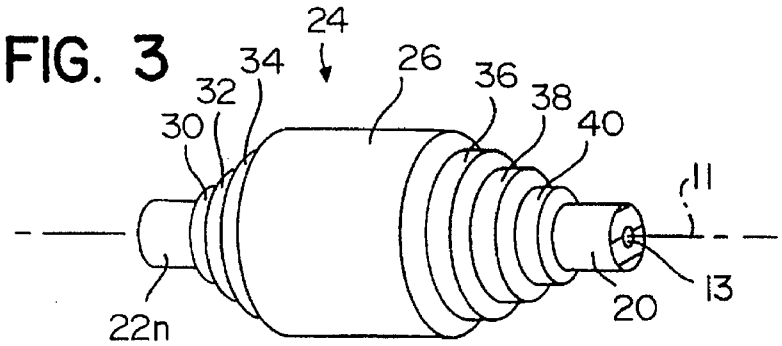
FIG. 3 is a perspective view of the bulge of FIG. 2.
Figure 2:
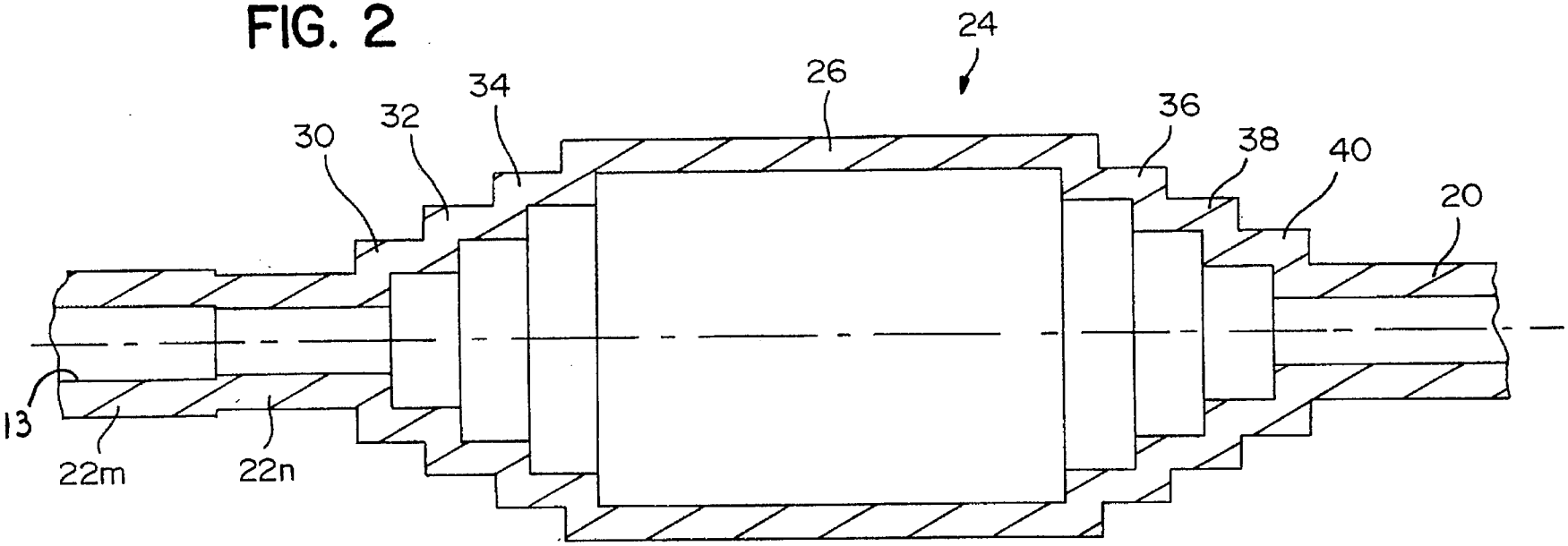
FIG. 2 is a partial view showing the bulge of FIG. 1 in accordance with certain principles of the invention.

In the preferred embodiment of the invention as shown in FIG. 1, a bulge 24 is formed in the shaft 12 and is located between, and joined to, section 22*n* and the tip end 20. Referring to FIGS. 2 and 3, the bulge 24 is formed with a central cylindrical section 26. The bulge 24 is formed with three cylindrical step surfaces 30, 32 and 34 at an inboard end of the central section and three cylindrical step surfaces 36, 38 and 40 at an outboard end thereof. In the preferred embodiment, the diameters of the step surfaces 30 and 40 are the same, and are greater than the diameter of the section 22*n* and the tip end 20. The diameters of the step surfaces 32 and 38 are the same, and are greater than the diameter of the step surfaces 30 and 40. The diameters of the step surfaces 34 and 36 are the same, and are greater than the diameter of the step surfaces 32 and 38. The diameters of all of the step surfaces 30, 32, 34, 36, 38 and 40 are less than the diameter of the central section 26 and the axial lengths of all of the step surfaces are the same prescribed length, which is less than the prescribed length of the central section. The wall thickness in the area of the bulge 24 is about 0.0185 inch to 0.019 inch. The various length and O.D. dimensions segments of the bulge 24 are also shown in the Parameter Table below.

In the following Parameter Table, the number in the left column identifies the segment of the preferred embodiment of the shaft 12 for which the length and outside diameter are listed.

PARAMETER TABLE

| Segment No. | Length in Inches | O.D. in Inches |
|---|---|---|
| 16 | 9.00 | 0.600 |
| 22a | 2.00 | 0.590 |
| 22b | 1.50 | 0.575 |
| 22c | 1.50 | 0.560 |
| 22d | 3.00 | 0.545 |
| 22e | 1.25 | 0.530 |
| 22f | 1.25 | 0.510 |
| 22g | 1.25 | 0.490 |
| 22h | 1.25 | 0.470 |
| 22i | 1.25 | 0.450 |
| 22j | 1.25 | 0.430 |
| 22k | 1.00 | 0.410 |
| 22l | 1.00 | 0.390 |
| 22m | 1.00 | 0.380 |
| 22n | 0.50 | 0.370 |
| 30 | 0.50 | 0.385 |
| 32 | 0.50 | 0.400 |
| 34 | 0.50 | 0.415 |
| 26 | 1.50 | 0.430 |
| 36 | 0.50 | 0.415 |
| 38 | 0.50 | 0.400 |
| 40 | 0.50 | 0.385 |
| 20 | 10.00 | 0.370 |
| 12 | 41.00 | |

The length, diameter and thickness dimensions noted above, and the structural configurations of the drawings, are of the preferred embodiment of the invention. Other length, diameter and thickness dimensions, and structural configurations can be used without departing from the spirit and scope of the invention.

In the preferred embodiment, the axial length of each of the step surfaces 30, 32, 34, 36, 38 and 40 is about one-third of the axial length of the central cylindrical section 26. This ratio of axial lengths provides at each end of the bulge 24 three comparatively short, but increasing, increments of stepping between (1) the common diameter of the section 22*n* and the tip end 20 and (2) the diameter of the central section 26. The three step surfaces 30, 32 and 34 at the inboard end of the central section 26, and the three short step surfaces 36, 38 and 40 at the outboard end of the central section, provide strength, integrity and support for the central section. In this manner, the central section 26 with the larger diameter and longer axial length, and the relatively long bulge 24 in general, are well supported in a section of the shaft 12 which includes the smallest diameter of the shaft. This allows the bulge 24 to provide enhanced performance for the golf club 10 which employs the shaft 12.

As shown in FIG. 1, 2 and 3, in the preferred embodiment, the bulge 24 is joined on one side to section 22*n*, which has the smallest diameter of any portion of the shaft 12, and is joined on the other side thereof with the tip end 20 which has a diameter of the same dimension as the diameter of section 22*n*. However, the bulge 24 could be located totally along any part of the intermediate section 22, the tip end 20 or a combination of the intermediate section and the tip end without departing from the spirit and scope of the invention.

The particular arrangement of the elements of the bulge 24 provide structural features of the shaft 12 which enhance the performance characteristics of the shaft when the shaft forms a portion of the golf club 10. By placement of the bulge 24 as illustrated in FIG. 1, the center of gravity of the club 10 is located closer to the tip end 20 of the shaft 12 than it would normally be in a bulgeless shaft. This feature permits the use of lighter weight club heads in the assembly of a finished golf club.

Figure 4:
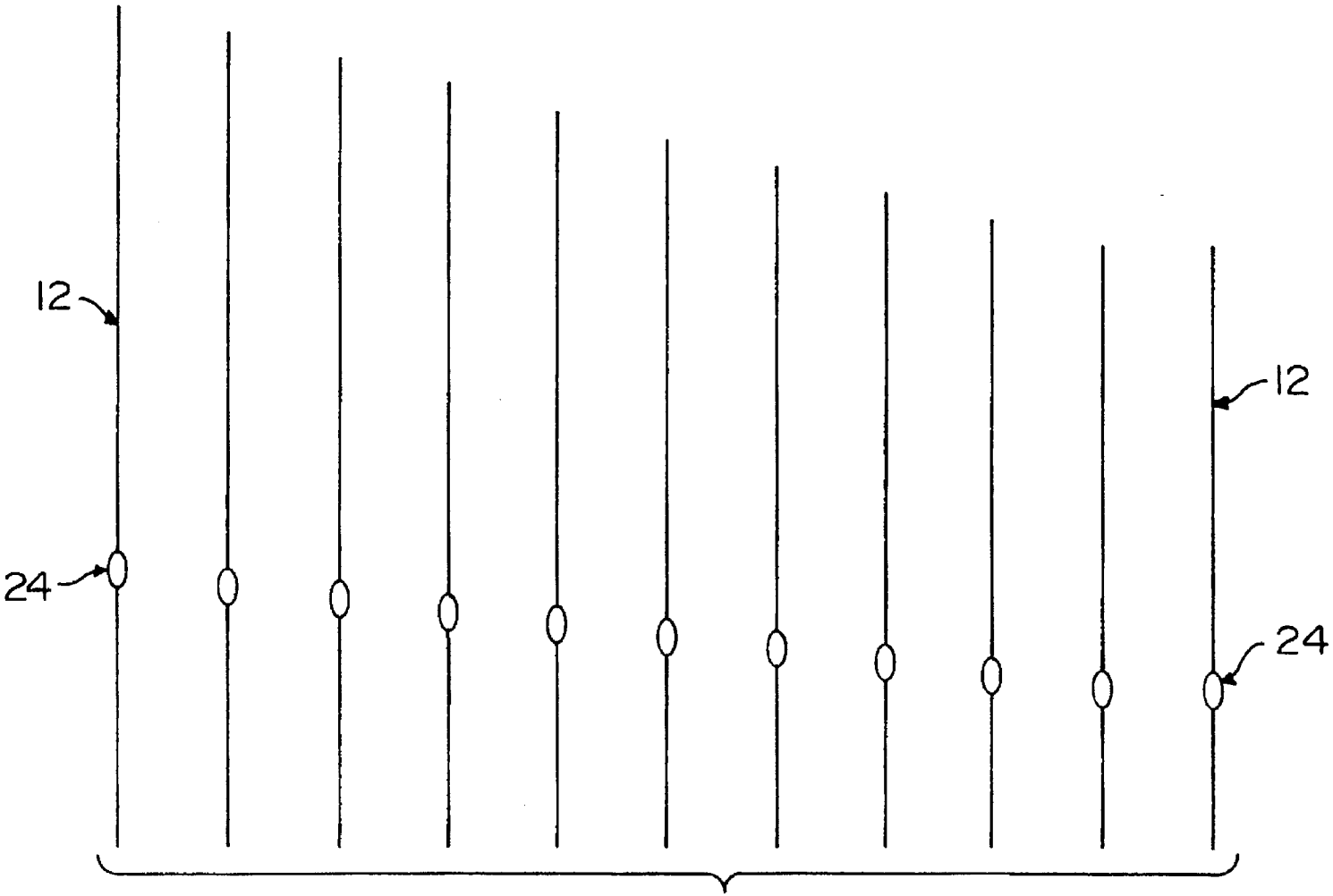
FIG. 4 is a diagram showing representations of the shafts of a set of golf clubs with the shaft of each club having a bulge formed thereon in accordance with certain principles of the invention to match the clubs of the set for consistent torsional performance.

As shown in FIG. 4, the presence and selective arrangement of the elements of the bulge 24 in a set of shafts 12 assist in the performance optimization of the individual clubs within the related set of golf clubs. In a matched set of golf clubs, each head exhibits unique dynamic characteristics. The moment of inertia and, consequently, the torsional requirements of each head within the set are different from each other. The bulge 24 and its positioning on the shaft 12 serve to address the torsional requirement of each head and normalize the torsional stability of each individual club within the set. This results in the matching of each club within the set from a torsional standpoint.

The presence of the bulge 24 in the shaft 12 serves to segment the shaft from a flexural standpoint. The bulge 24 allows different combinations of flexural stiffness in the portions of the shaft 12 between the bulge and the butt end 16 on the one side, and the bulge and the tip end 20 on the other side. The combining of different flexural stiffness with the shaft 12 contributes to a particular golf shot trajectory, depending on the combination used. For example, if the shaft 12 is designed with both of the abovenoted portions being flexible, the resultant golf shot trajectory would be higher than if the shaft was designed with both portions being fairly stiff or rigid. In accordance with the principles of this invention, the bulge 24 allows several permutations of this concept in order to optimize both the golf ball launch angle when struck with the golf club 10 and the resultant golf shot trajectory.

In general, the above-identified embodiment is not to be construed as limiting the breadth of the present invention. Modifications, and other alternative constructions, will be apparent which are within the spirit and scope of the invention as defined in the appended claims.

What is claimed is:

1. A golf club shaft, which comprises:

a metallic body extending longitudinally along an axis thereof;

the body formed with a butt end formed at one end thereof having an inboard extremity of a prescribed diameter and an outboard extremity;

the body formed with a tip end formed at an end thereof axially opposite the butt end and spaced axially therefrom and having an inboard extremity of a diameter less than the prescribed diameter and an outboard extremity;

the body formed with an intermediate section which extends from the inboard extremity of the butt end toward the tip end wherein the diameter of an end of the intermediate section which joins the butt end is the same as the prescribed diameter and the diameter of an opposite end of the intermediate section is less than the prescribed diameter;

a bulge formed in the body along the axis thereof; and the bulge formed with radially-outward-extending axially-spaced stepped portions joined with opposite ends of a central shell-like portion between the stepped portions said central shell-like portion extending radially from the axis of the body by a distance which is greater than the diameter of at least the stepped portions immediately adjacent the opposite ends of the central shell-like portion.

2. The golf club shaft as set forth in claim 1, wherein the bulge is formed in the tip end.

3. The golf club shaft as set forth in claim 1, wherein the bulge is formed in the intermediate section.

4. The golf club shaft as set forth in claim 1, wherein the bulge is formed with an axial length where a first portion of the axial length is located in the tip end and a second remaining portion of the axial length is located in the intermediate section.

5. The golf club shaft as set forth in claim 1, wherein the central shell-like portion extends radially from the axis of the body by a distance which is greater than the diameter of the portions of the body immediately adjacent the bulge.

6. The golf club shaft as set forth in claim 1, wherein the stepped portions of the bulge include at least one step at each end of the bulge which extends radially from the axis of the body by a distance greater than the diameter of the portions of the body immediately adjacent the bulge.

7. The golf club shaft as set forth in claim 1, wherein the stepped portions of the bulge include three steps at each end of the bulge which extend axially between the immediately adjacent portion of the body and the central shell-like portion of the bulge and which extend radially from the axis of the body by a distance greater than the diameter of the portions of the body immediately adjacent the bulge.

8. The golf club shaft as set forth in claim 7, wherein the three steps at each end of the bulge include:

a first step joined at a first end thereof with the immediately adjacent portion of the body and extending radially outward from the axis of the body by a first distance which is greater than the diameter of the adjacent portion of the body;

a second step joined at a first end thereof with a second end of the first step and extending radially outward from the axis of the body by a second distance greater than the first distance, a third step joined at a first end thereof with a second end of the second step and extending radially outward from the axis of the body by a third distance greater than the second distance; and a second end of the third step joined with a respective end of the central shell-like portion of the bulge.

9. The golf club shaft as set forth in claim 8, wherein the opposite ends of the central shell-like portion are joined with respective ones of the third steps and the central portion extends radially outward from the axis of the body by a distance greater than the third distance.

10. The golf club shaft as set forth in claim 8, wherein each of the first, second and third steps extend circumferentially around the axis of the body.

11. The golf club shaft as set forth in claim 10, wherein the central shell-like portion extends circumferentially around the axis of the body.

12. The golf club shaft as set forth in claim 1, wherein the butt end is formed with a uniform diameter from the outboard extremity to the inboard extremity thereof.

13. The golf club shaft as set forth in claim 1, wherein the tip end is formed with a uniform diameter from the outboard extremity to the inboard extremity thereof.

14. The golf club shaft as set forth in claim 1, wherein the intermediate section is formed with a plurality of cylindrical segments of successively decreasing diameters beginning with the segment of greatest diameter which is joined with the inboard extremity of the butt end to the segment of smallest diameter which is joined with the inboard extremity of the tip end.

15. A golf club shaft, which comprises:

a metallic tube;

a butt end at one end of the tube and a tip end at another end of the tube spaced axially therefrom;

at least a portion of the tube between the butt and tip ends thereof being formed with a first end diameter at a first end thereof which is closer to the butt end and a second end diameter at a second end thereof with a diameter smaller than the first diameter and closer to the tip end;

a section of the tube extends between the first end and the second end of the portion and is formed with successively smaller diameters from the first end to the second end within a range of diameters between the first end diameter and the second end diameter;

a bulge formed in the tube between the second end of the portion and the tip end;

the bulge formed with a central cylindrical section of a prescribed axial length and a prescribed diameter greater than the second end diameter;

the bulge further formed with a pair of first step surfaces with a respective one of the first step surfaces joined to each end of the central section and having a first step diameter which is less than the central section diameter and greater than the second end diameter;

the bulge further formed with a pair of second step surfaces with respective ones of the second step surfaces joined at one of two ends thereof to respective ones of the pair of first step surfaces;

one of the pair of second step surfaces joined at another of the two ends thereof with the second end of the portion of the tube and the other of the pair of second step surfaces joined at another of the two ends thereof with the tip end of the tube; and the pair of second step surfaces being formed with a second step diameter which is less than the first step diameter and greater than the second end diameter.

16. A golf club, which comprises:

a golf club shaft having a metallic body extending longitudinally along an axis of the body;

the body formed with a butt end formed at one end thereof having an inboard extremity of a prescribed diameter and an outboard extremity;

the body formed with a tip end formed at an end thereof axially opposite the butt end and spaced axially therefrom and having an inboard extremity of a diameter less than the prescribed diameter and an outboard extremity;

the body formed with an intermediate section which extends between the inboard extremities of the butt end and the tip end wherein the diameter of an end of the intermediate section which joins the butt end is the same as the prescribed diameter and the diameter of an end of the section which joins the tip end is the same as the diameter of the inboard extremity of the tip end;

a bulge formed in the body along the axis thereof;

the bulge formed with radially-outward-extending axially-spaced stepped portions joined with opposite ends of a central shell-like portion between the stepped portions said central shell-like portion extending radially from the axis of the body by a distance which is greater than the diameter of at least the stepped portions immediately adjacent the opposite ends of the central shell-like portion;

a grip assembled on the butt end of the body; and a club head assembled on the tip end of the body.

17. The golf club as set forth in claim 16, wherein the stepped portions of the bulge include at least one step at each end of the bulge which extends radially from the axis of the body by a distance greater than the diameter of the portions of the body immediately adjacent the bulge.

18. The golf club as set forth in claim 16 wherein the stepped portions of the bulge include three steps at each end of the bulge which extend axially between the immediately adjacent portion of the body and the central shell-like portion of the bulge and which extend radially from the axis of the body by a distance greater than the diameter of the portions of the body immediately adjacent the bulge.

19. The golf club as set forth in claim 18, wherein the three steps at each end of the bulge include:

a first step Joined at a first end thereof with the immediately adjacent portion of the body and extending radially outward from the axis of the body by a first distance which is greater than the diameter of the adjacent portion of the body;

a second step joined at a first end thereof with a second end of the first step and extending radially outward from the axis of the body by a second distance greater than the first distance, a third step joined at a first end thereof with a second end of the second step and extending radially outward from the axis of the body by a third distance greater than the second distance; and a second end of the third step joined with a respective end of the central shell-like portion of the bulge.

20. The golf club as set forth in claim 19, wherein the opposite ends of the central shell-like portion are joined with respective ones of the third steps and the central portion extends radially outward from the axis of the body by a distance greater than the third distance.

21. The golf club as set forth in claim 19, wherein each of the first, second and third steps extend circumferentially around the axis of the body.

22. The golf club as set forth in claim 21, wherein the central shell-like portion extends circumferentially around the axis of the body.

* * * * *